United States Patent [19]

Cacciapuoti

[11] 4,432,397

[45] Feb. 21, 1984

[54] NOISELESS HIGH-SPEED CIRCULAR LOOM FOR PRODUCING TUBULAR FABRICS CONSISTING OF STRIPS, THREADS AND THE LIKE MADE OF SYNTHETIC OR NATURAL MATERIALS

[75] Inventor: Beniamino Cacciapuoti, Aulla, Italy

[73] Assignee: Moplefan S.p.A., Milan, Italy

[21] Appl. No.: 325,596

[22] Filed: Nov. 27, 1981

[30] Foreign Application Priority Data

Dec. 12, 1980 [IT] Italy ..... 26612 A/80

[51] Int. Cl.[3] ..... D03D 37/00

[52] U.S. Cl. ..... 139/13 R

[58] Field of Search ..... 139/13 R, 13 A, 14, 139/15, 16

[56] References Cited

U.S. PATENT DOCUMENTS 2,168,385 8/1939 Baumgarten ..... 139/13 R

FOREIGN PATENT DOCUMENTS 821479 11/1951 Fed. Rep. of Germany .... 139/13 R
1088436 9/1960 Fed. Rep. of Germany .... 139/13 R
609381 9/1960 Italy ..... 139/13 R
WO80/01173 6/1980 PCT Int'l Appl. ..... 139/13 R

*Primary Examiner*—Henry Jaudon
*Attorney, Agent, or Firm*—Stevens, Davis, Miller & Mosher

[57] ABSTRACT

A circular loom is disclosed for the manufacture of tubular fabrics made of threads and/or strips of polymeric materials. The loom is of the type having heddles on two concentric circles and a central driving shaft, which comprises, for the alternate spreading apart of the warp threads, a support member, mounted coaxially and rotating around the central and vertical loom shaft, on which support one or more pairs of wings or flyers or circular sectors diametrically opposed to one another are coupled under a predetermined and fixed angle of inclination in respect of the axis of said central shaft, each pair of wings or circular sectors being coupled in an inclined manner on said support member with interposition of a roller bearing so as to prevent said wings, through means connecting such wings with fixed parts of the loom, from rotating around said support member when the loom is working and thus assuming a continuous undulatory motion, the end portions of said opposite and oscillating wings or circular sectors being connected, through a plurality of tie rods, with eye-bearing elastic members and having the function of elastic heddles so as to transfer the undulatory motion of said wings to said elastic heddles and therefore to achieve, along the development of the loom reed and by using additional pairs of wings, the necessary spreading apart of the warp threads which is suited to form the wave shed or pitch, rolling means associated with conventional shuttle pushers being furthermore provided for the shuttle drive.

6 Claims, 7 Drawing Figures

NOISELESS HIGH-SPEED CIRCULAR LOOM FOR PRODUCING TUBULAR FABRICS CONSISTING OF STRIPS, THREADS AND THE LIKE MADE OF SYNTHETIC OR NATURAL MATERIALS

This invention relates to a circular loom for the continuous weaving of threads, strips, straps and the like made of any suitable materials, preferably plastic materials, such loom being improved so as to allow high rotational speeds and consequently a high productivity, a particularly low noise index, and a high technological and mechanical reliability.

As is well known, the conventional circular looms for the manufacture of tubular fabrics consisting or consisting essentially of straps or strips of plastic material, comprise two sets of heddles arranged on two concentric circles and subjected to reciprocating upward and downward movements to achieve an alternate spreading apart of the warp threads and so to create the so-called "wave pitch". The warp threads are guided through a cylindrical reed and are then deviated or directed into a hollow vertical cylindrical body (fabric gauge), the fabric being formed on the upper or lower circular edge thereof due to the insertion of the weft threads among the warp threads.

The weft threads are fed by one or more shuttles carrying on board thread bobbins, and are caused to rotate on the circular reed and are guided on the latter through proper guiding shoes. The shuttles, due to their rotation between the alternatively open zones of the warp threads, feed their own weft thread among said warp threads according to a spiral which closes on the edge of the vertical cylindrical body. As a consequence the tubular fabric continuously forms on the circular edge of said cylindrical body, wherefrom it is continuously drawn and wound into bobbins.

The circular looms commercially available at present exhibit several limitations and drawbacks of which, chiefly, one may mention a low production speed (maximum speed: 150 r.p.m.), an excessive noise, and a low autonomy of product fed to the bobbins.

The low speed is due in fact to forces of inertia in the masses, subjected to the reciprocating motion of the heddles and corresponding control kinematic motions, such forces of inertia limiting the stroke of the heddles and, in consequence, the dimensions of the opening sections of the wave pitch and therefore also the transversal sections of the shuttles, with reduction in the capacities of the weft bobbins and hence of the loom autonomy. Furthermore, the mechanical structure of said conventional looms is very complex and highly stressed, wherefore the mechanical reliability is remarkably reduced. Finally, the conventional circular looms are very expensive, exhibit a top-high noise index and require constant lubrication. A further limitation is due to the impossibility of carrying out crossings of warp threads with weft threads different from the simple crossing type, as well as the drawback of having warp threads which are compelled to sweep the guide rings of the contiguous heddles, to the serious detriment of the integrity of the warp threads.

Thus it is an object of the present invention to provide a circular loom for manufacturing tubular fabrics starting from threads or strips of polymeric materials in general, which is structured in such manner as to obtain the alternate movement of the heddles, bearing the warp threads, by means of kinematic elements of very reduced mass so as to release the motion of the heddles from the masses of their reciprocating control and guide members, which members, just due to their mass, would otherwise markedly limit the loom performance.

It is another object of this invention to provide a loom of the type specified hereinbefore, capable of effecting the alternate spreading apart of the warp threads by means of control and guide mechanisms subjected to a particular continuous undulatory motion such as to free the loom speed from any inertial stress and from the noise. In fact, in the absence of any heavy members undergoing reciprocating motions, the noise tends to disappear.

A still further object is that of providing a circular loom of particular structural simplicity, high reliability, and moderate cost, such as to require only a very reduced maintenance work, no periodic lubrication and, above all, capable of allowing the carrying out of more types of thread crossings for the manufacture of fabrics endowed with particular aesthetic effects.

A further object of this invention is that of providing along with said particular controlled kinematic motion of the heddles, an efficient guide and control mechanism for the shuttles along the reed circumference, such mechanism consisting of guiding shoes and of wheels resting on the reed, suitable for preventing any sliding friction between shuttles and reed.

The principle of the operation of the loom, and in particular of the alternate or reciprocating spreading apart kinematic system of the warp threads, free from mechanical members affected by linear reciprocating motions, is theoretically similar to an undulatory reciprocating motion, corresponding to that which in rational (applied) mechanics is defined as "movement of regular retrograde precession", the angular speed of which varies according to the sinusoidal law and therefore is such as to be free from high momentary variations. Such precessional movement is explained in more detail hereinafter.

The objects and advantages specified above are achieved in practice by a circular loom for tubular fabrics prepared from threads and/or strips of polymeric materials, natural materials and the like, of the type equipped with heddles arranged on two concentric circles and with a central driving shaft, such loom providing, for the reciprocating spreading apart of the inner and outer warp threads, a supporting member, coaxially rotating around the central and vertical shaft of the loom, one or more pairs of wings or circular sectors preferably diametrically opposed to one another and being coupled, under a predetermined and fixed angle of inclination in respect of the axis of said shaft, on said support, each pair of wings being coupled in an inclined manner on said supporting member with interposition of a roller bearing so as to prevent said wings, through means effecting an oscillating connection of the wings with fixed parts of the loom, from rotating around said supporting member when the loom is working and so assuming a continuous undulatory motion, the end portions of said opposite and oscillating wings being connected, through a plurality of tie rods or the like, with eye-bearing elastic members acting as elastic heddles, so as to transfer the undulatory motion of said wings to said elastic heddles and therefore to obtain, along the development of the loom reed and by using more pairs of wings, the necessary spreading apart of the warp threads which is suited to form the wave pitch, rolling means associated with conventional shuttle pushers, as well as multiple-wheel devices, suited to provide a support and a guide for the shuttles (without sliding friction between shuttles and cylindrical reed) being furthermore provided for the driving of the shuttles.

More particularly, said support member for said pairs of wings or circular sectors consists of a tubular shaft, coaxially rotating with the vertical shaft of the loom, on which as many coaxial bushings as the pairs of opposed wings are keyed, each of said bushings having their cylindrical outer surface inclined at a fixed angle in respect of the rotational axis of the loom shaft and of the bushing-holding tubular shaft, on said cylindrical inclined surface a radial bearing being then mounted which, in its turn, carries a pair of opposite wings.

Still more particularly, said means for the oscillating connection of each oscillating wing with a fixed part of the loom consists or consists essentially of rigid locking means or of pendulum connections, capable of allowing said wings, when the loom is working, to oscillate in a substantially vertical plane without angular shiftings around the loom shaft, while said elastic eye-bearing members acting as heddles are made of steel wires, preferably bent at an angle and connected with a fixed part of the loom.

Always according to this invention, in order to obtain a configuration of the wave pitch of the warp threads capable of reversing at every shuttle run, the tubular bushing holding shaft is subjected to a speed which is twice that of the loom shaft when the loom is equipped with four shuttles, three times that of the loom shaft when the loom is equipped with six shuttles; and in general the speed variation will be determined by the following formula $$N_b = N(K/2)$$

wherein $N_b$ = number of revolutions of the bushings per minute, N = number of revolutions of the loom per minute, and K = number of shuttles.

The constructional and functional characteristics of the circular loom which is the object of the present invention, in a preferred although not exclusive embodiment, are described more in detail hereinafter making reference to the enclosed drawings, which are given merely for illustrative but not limiting purposes, and in which:

FIGS. 1, $\mathbf{1}_a$, $\mathbf{1}_b$ and $\mathbf{1}_c$ show the theoretical diagram of the precessional movement of three axes (in four angular positions) around three other fixed axes, and intended to still further explain the alternate spreading apart of warp threads in the loom;

Figure 5:
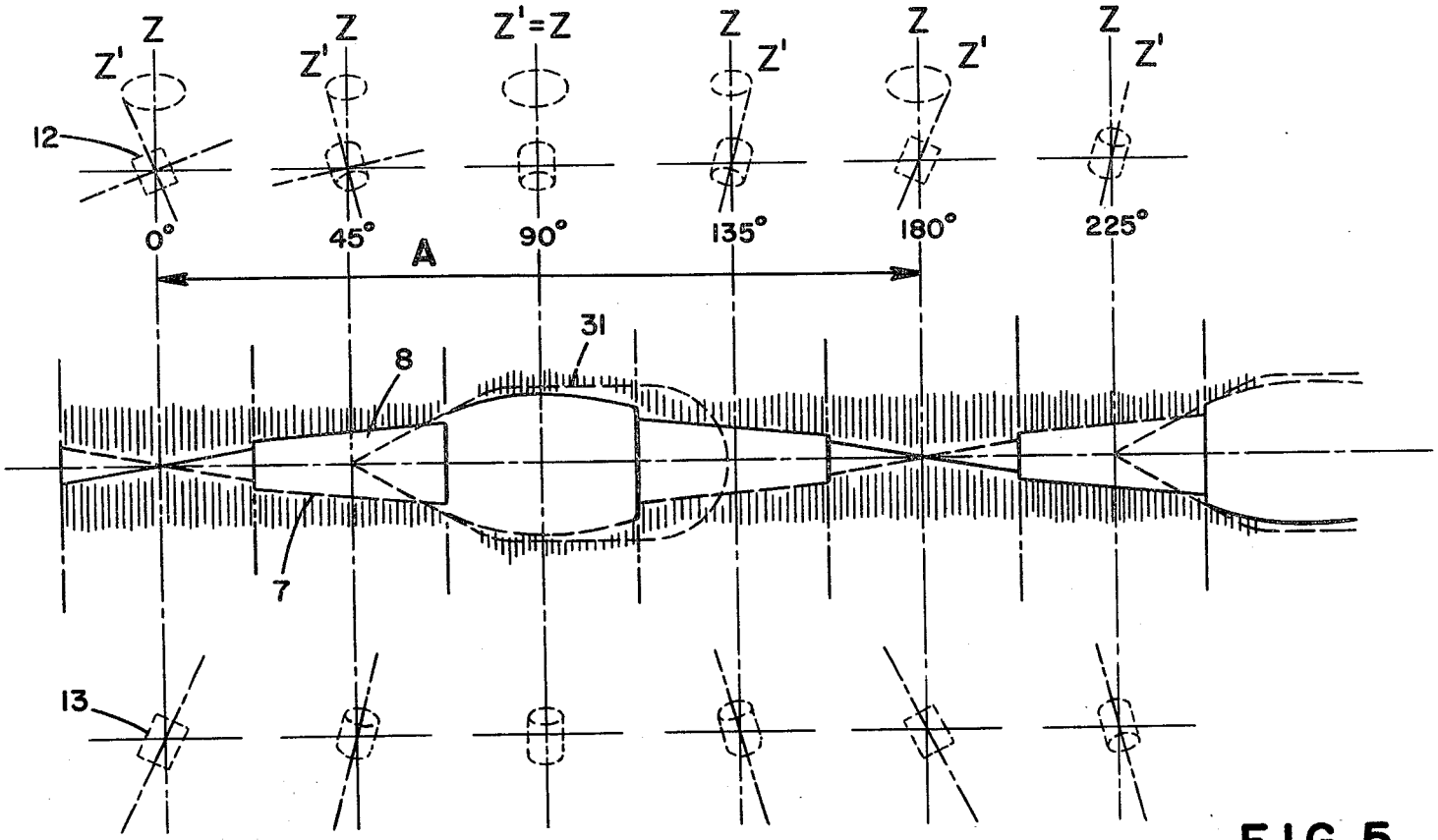
Figure 6:
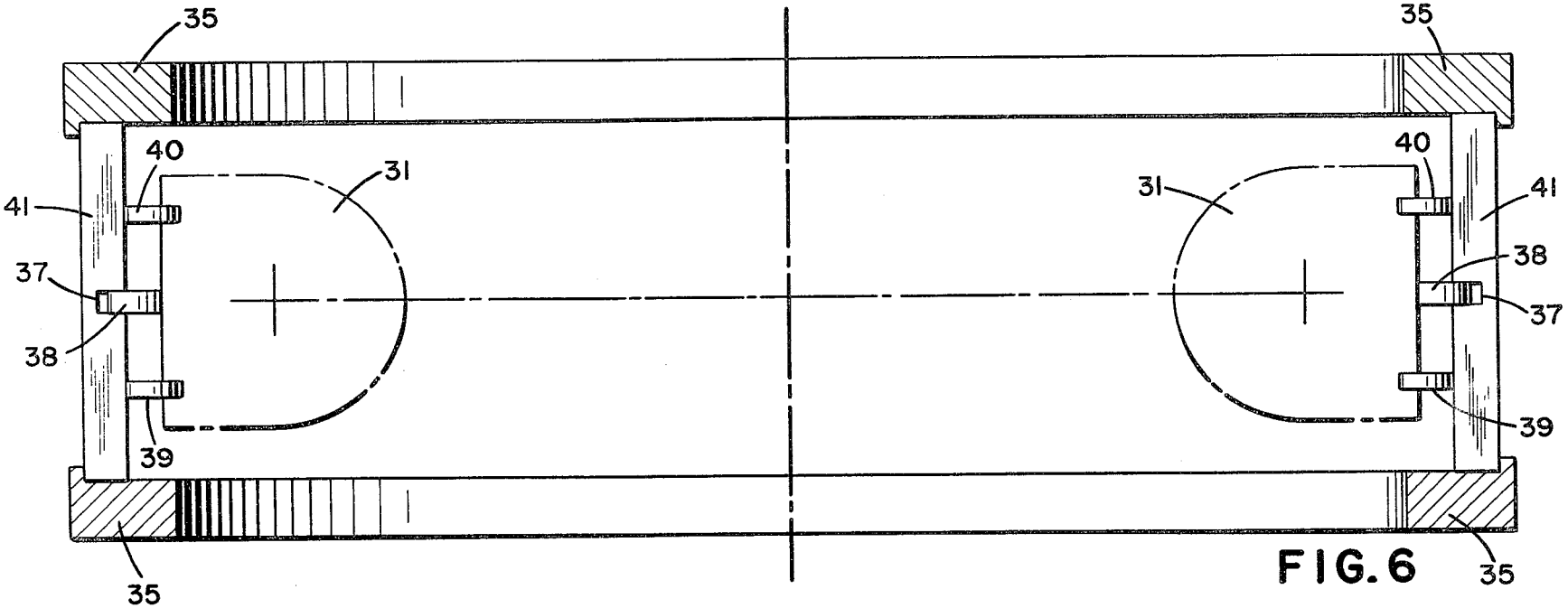
Figure 7:
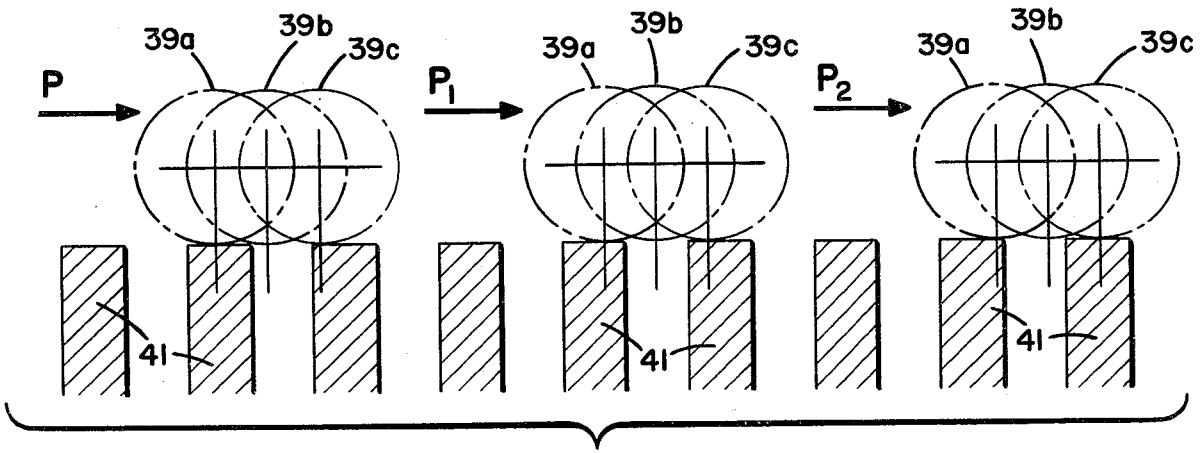

FIG. 5 shows a plane development of the undulatory motion scheme of the wings or circular sectors and the successive (positive or negative) openings of the warp threads forming the wave pitch required for penetration by the shuttles; and FIGS. 6 and 7 show schematically, in diametric sections and in a plane-developed side view respectively, the guiding and supporting devices of a shuttle on the cylindrical reed of conventional type.

As already explained above, the principle on which the operation of the loom of the present invention is based, and in particular the principle of the reciprocating spreading apart of the warp threads, is similar to an undulatory motion corresponding to the regular precessional motion. Such precessional motion is schematically represented in FIGS. 1 to $\mathbf{1}_c$, wherein four successive angular positions of a group of three axes rotating around another fixed group of three axes are shown.

Figure 1:
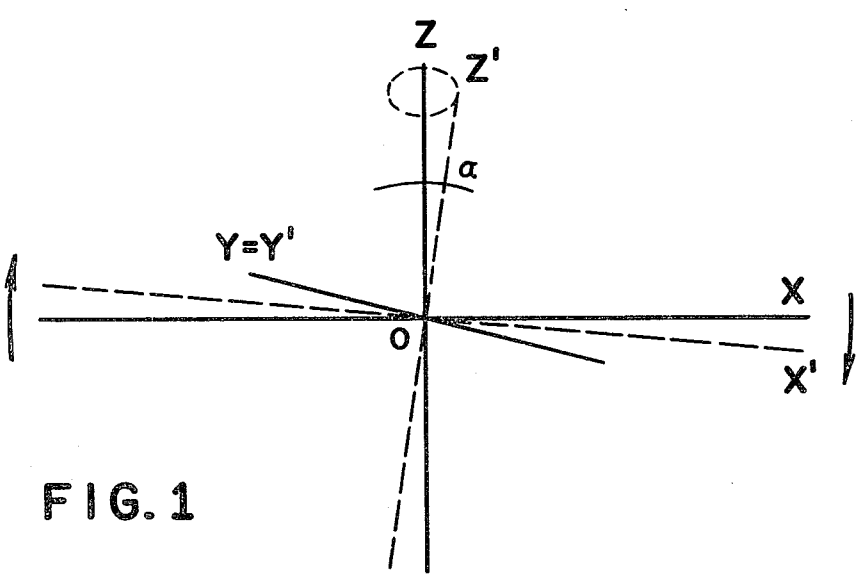
Figure 1A:
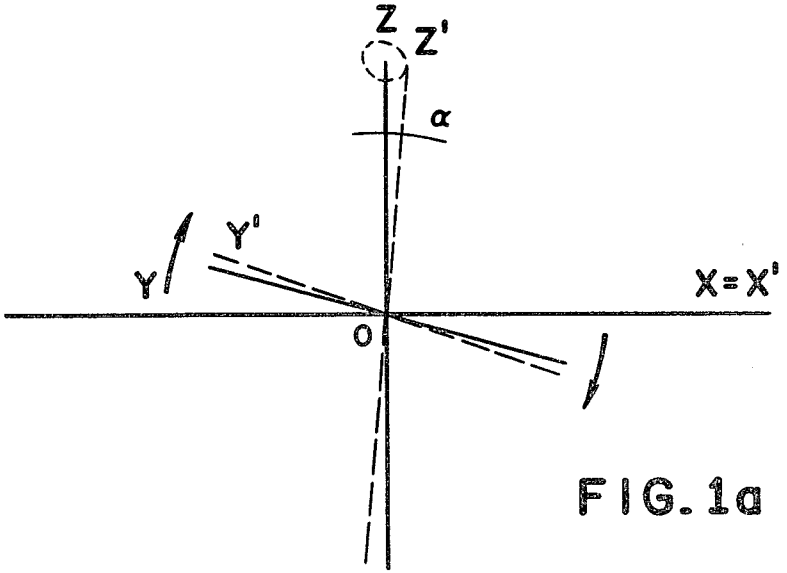
Figure 1B:
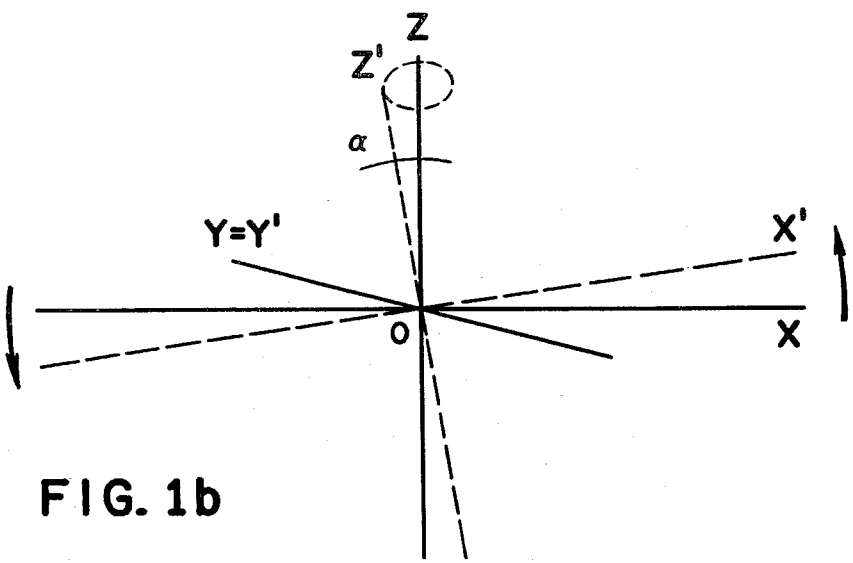
Figure 1C:
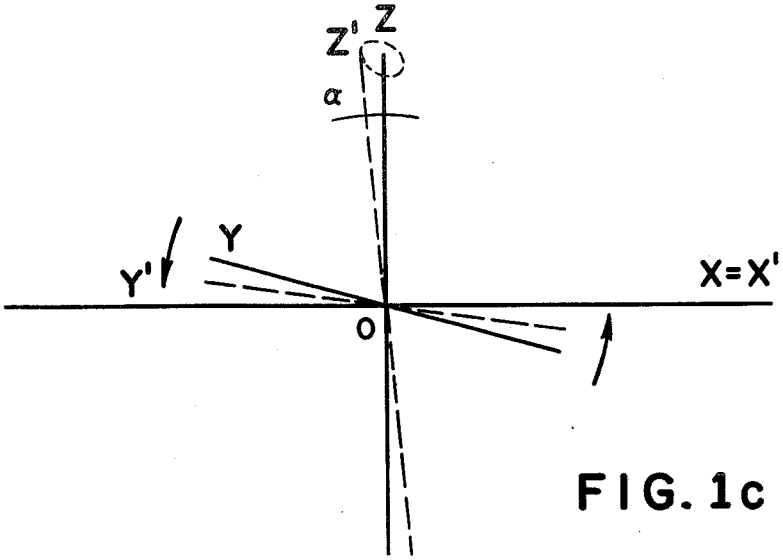

Therefore, and with reference to FIGS. 1-$\mathbf{1}_a$-$\mathbf{1}_b$-$\mathbf{1}_c$, if there are given a reference group of three axes X, Y, Z fixed in space and a second group of three axes X', Y', Z' integral with the first group in having a common origin O, but with axis Z' inclined at an angle $\alpha$ (with respect to Z), then when axis Z' performs a rotary motion in respect of Z, it will describe with the positive axis a conical surface having its concavity turned upwards and the vertex in the common axis O. Consequently, axes X' and Y', if kept unchanged in their orientation in respect of axis Z (and therefore always lying in planes X-Z and Y-Z), will be compelled, due to the rotary oscillation of Z', to alternately oscillate upwards and downwards with harmonic motion, i.e., free from intense acceleration.

FIGS. 1 to $\mathbf{1}_c$ show four consecutive positions or orientations of axis Z' in respect of axis Z and, precisely, a starting position (FIG. 1), at 90° in FIG. $\mathbf{1}_a$, at 180° in FIG. $\mathbf{1}_b$ and at 270° in FIG. $\mathbf{1}_c$.

Supposing that axis Z is coincident with the axis of the loom (the circular loom is a machine with an axis of symmetry coincident with the axis of rotation), then it is sufficient to utilize the motion of the positive and negative ends of axes X' and Y' to achieve the reciprocating motion required to control the warp threads for the interlacement with the weft threads.

In practice, it is therefore possible to key, on the loom central shaft, bushings or analogous elements having external surfaces with axes inclined as axis Z', and to mount on said bushings radial bearings and to couple thereon two wings or opposed circular sectors, embodying axes X' and Y'. If said opposed and inclined wings are then held at their end portions, for example by articulated pendulum connections or other oscillation clamping means, so as to remain in planes X-Z and Y-Z, an undulatory motion is obtained for said wings, which can be used to control elastic members acting as heddles.

The circular loom according to this invention is therefore characterized in utilizing kinematic motions operating on the basis of the principle described above.

Figure 2:
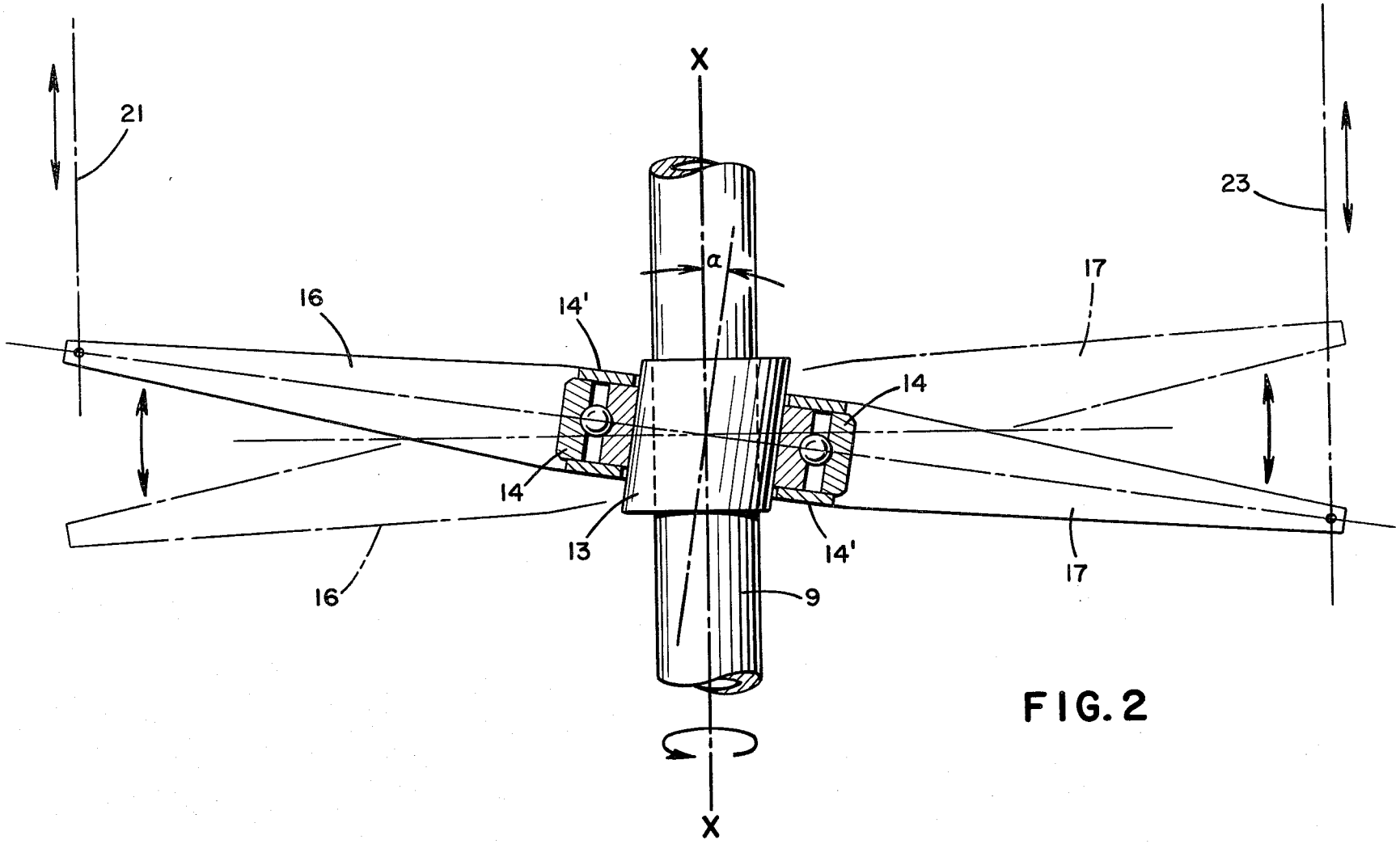
FIG. 2 shows, axially in section, an enlargd detail of the reciprocating spreading apart device of the warp threads, included in the circular loom.
Figure 3:
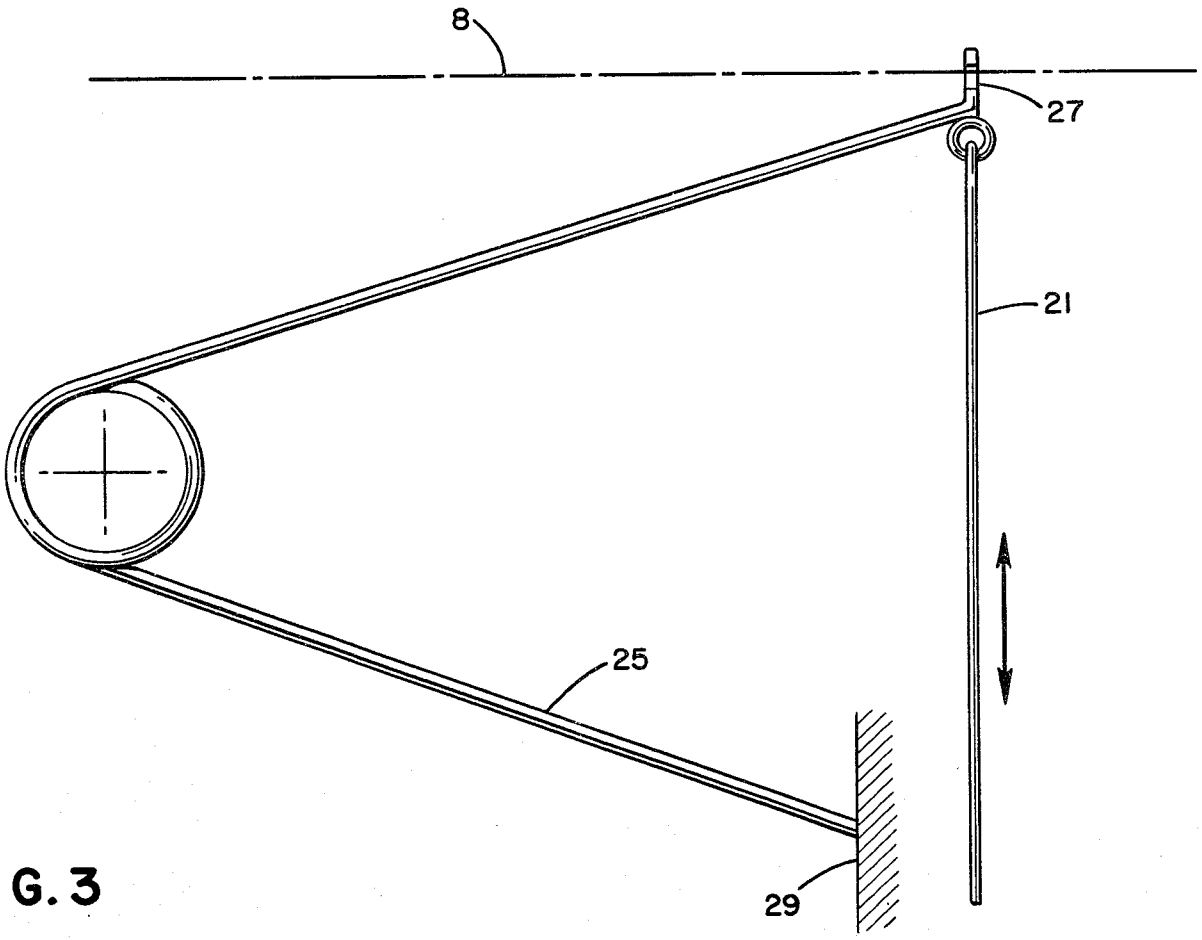
FIG. 3 shows a side view of a detail of the loom including an elastic member with eye constituting a heddle for said loom.
Figure 4:
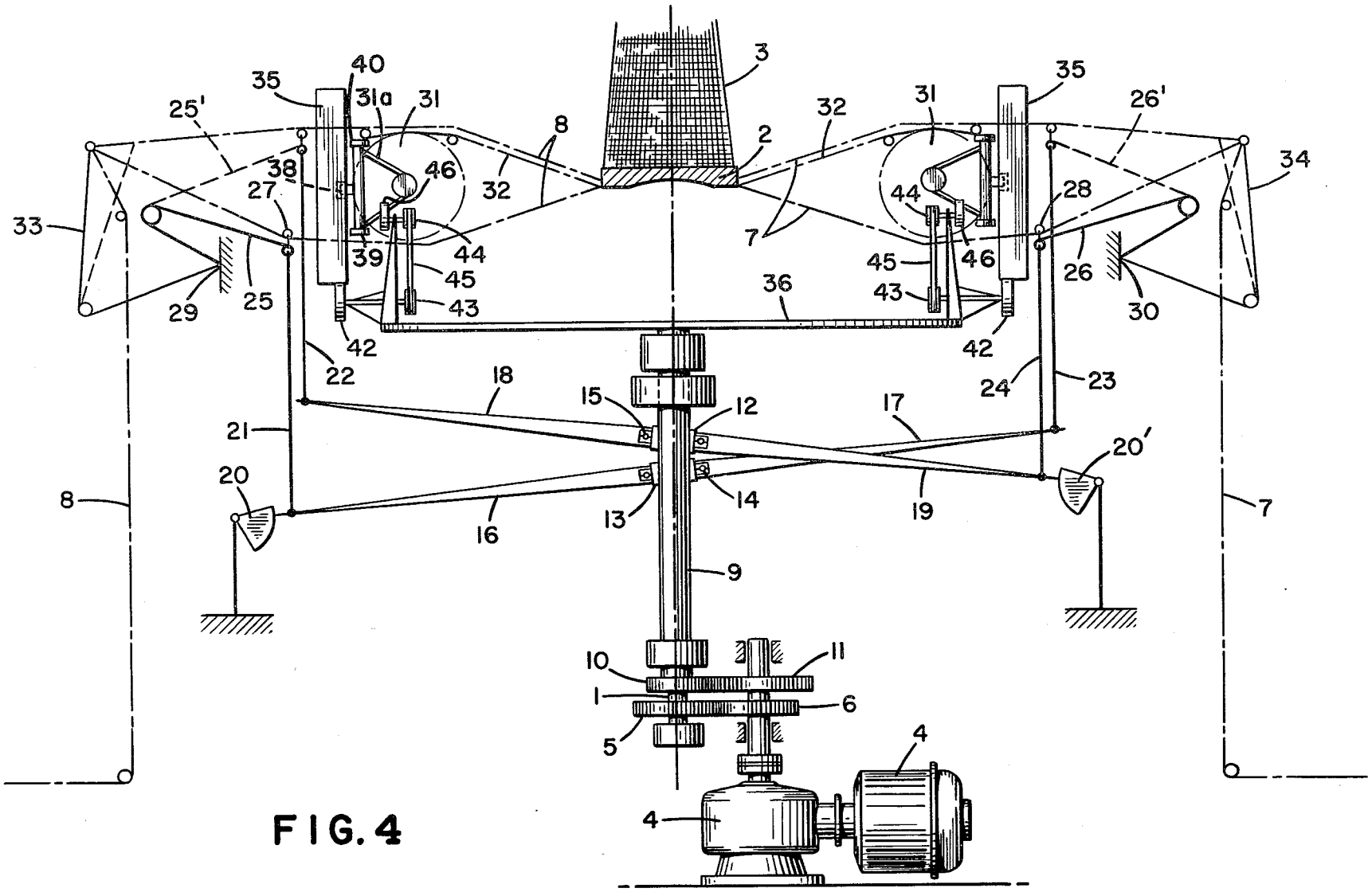
FIG. 4 shows schematically an axial section of the circular loom.

Making reference now to the remaining figures, and in particular FIGS. 2, 3 and 4, the circular loom of this invention is essentially of the type having a vertical central shaft 1, arranged coaxially with hollow body 2 which forms fabric 3 and driven by a geared motor 4 (FIG. 4) through gears 5 and 6.

The spreading apart of warp threads 7, 8, etc., (FIG. 4) is achieved, according to the present invention, by coaxially associating with inner shaft 1 of the loom a hollow outer shaft 9 (FIGS. 2 and 4), driven independently of shaft 1 through gears 10 and 11, and which are driven by said geared motor 4. Bushings 12, 13, etc., in a number fixed in advance on the basis of the number of shuttles (as indicated above), are keyed on hollow shaft 9, to attain a higher continuity of the wave pitches, as further explained below.

For simplicity's sake, only two bushings 12 and 13 are shown in FIG. 4. Each bushing is keyed on shaft 9 coaxially therewith and is designed so as to have its external cylindrical surface inclined at a predetermined angle (FIGS. 2 and 4) in respect of the axis of shaft 9. This angle oof inclination is the same for all the bushings keyed coaxially with shaft 9, but the orientation or angular position or location of the one of the other is suitably offset, depending on the number of bushings in order to achieve, as already mentioned, a good continuity of the wave pitch.

On each bushing 13 (FIG. 2) a roller bearing 14 is keyed and on this roller bearing a hub 14' holding two wings 16–17 diametrically oposed to each other is coupled. The free end portions of said opposed wings are prevented from rotating around shaft 9 by pendulum-oscillating clamping means or the like, as schematically shown with 20 and 20' in FIG. 4, wherefore, thanks to the presence of the bearing, the wings are capable of oscillating in substantially vertical planes without rotating.

The end portions of the wings are then each connected by a plurality of tie rods 21–22 and 23–24 with elastic members 25–26 (FIGS. 3–4), having an end eye 27–28 through which warp thread 8 and 7, respectively, is made to pass. These elastic members act therefore as heddles; they consist of V-bent steel wires as shown in FIGS. 3 and 4, and are fastened at 29–30 to fixed parts of the loom and can therefore bend and extend under the action of the respective tie rods when they are alternately driven by the oscillating wings 16 and 17. In FIG. 4, 25' and 26' indicate, in dashed lines, the same eye-bearing elastic elements 25–26 when they assume the most extended position; the distance or aperture between the lower position of element or member 25 (or 26) and the upper position 25' (or 26') constitutes the wave pitch necessary to allow the passage of shuttle 31.

In FIG. 4, 32 indicates schematically a weft thread carried by shuttles 31, while 33 and 34 indicate elastic members, bent at an angle and fixed to the fixed portion of the loom, such elastic members being of the conventional type and having the function of providing the necessary compensation in length of the continuously fed warp threads.

The circular loom includes furthermore the usual cylindrical reed 35 and a disc-shaped platform 36 transversely keyed on the top of shaft 1, the principal function of which is that of controlling the shuttle motion by means of particular shuttle-pushers and shuttle-guiding devices which will now be described.

As already mentioned above, to obtain a good conformation of the wave pitch destined to reverse at every passage of the shuttle, hollow shaft 9 carrying the bushings must rotate with a number of revolutions twice that of loom shaft 1 for four-shuttle looms, three times that of shaft 1 for six-shuttle looms, and, generally, in accordance with the formula indicated above.

In practice, 8 pairs of oscillating wings distributed over the arc of 360° of the circumference of a circle are required to achieve an acceptable wave pitch.

To obtain a higher continuity in the sinusoidal motion of the heddles forming the wave pitch, it is advisable to provide a greater number of pairs of oscillating wings wherefore, in practice, although not strictly necessary, thanks to the capability of the shuttle to complete by itself the opening of the threads by virtue of a further specific arrangement concerning the reed-shuttle couplin—such arrangement being illustrated hereinafter—more than four wings are utilized, thus dividing the loom into a number of sectors which are multiples of 2, 4 or 6 depending on whether the loom has 2, 4 or 6 shuttles.

In the practical case of a loom having 4 shuttles, it is sufficient to use 8 or 12 wings as desired.

FIG. 5 illustrates, developed in a plane, the conformation of the wave pitch between two warp threads and in particular the development of a quadrant (90°) of a loom, indicated by A, and the corresponding position of bushings 12–13, etc., which bushings, over the arc of 90° of said quadrant of the loom (always indicated by A), make a rotation of 180° passing through the positions shown in this Figure from 0° to 180°.

The predetermined inclination angle of axis Z' of a bushing around fixed axis Z, passing from the starting position to that at 45°, 90° etc., involves oscillations of the wings such as to obtain a sufficient and almost regular opening of warp threads 8 and 7 which is suitable for penetration by shuttle 31.

In FIG. 5, the non-hatched area between threads 7 and 8 represents the wave pitch.

Always according to the present invention, to improve the functionality of the loom, reed 35 is shaped so as to contain a central groove 37 (FIG. 6) adapted to act as a guide for the shuttles which, for this purpose, are equipped with a central sliding shoe 38 firmly inserted in said groove. The usual slipping supports for the bobbin on the upper and lower inner edges of the vertical-blade reed are thus eliminated. It follows that in such an embodiment the warp threads are not pressed between shuttle and reed edges, but are free to move forward. Furthermore, groups of supporting wheels 39–40 are associated with each shuttle so as to avoid the sliding friction against the reed and to further reduce the noise of the loom. Each group of wheels 39–40 actually consists of three idler wheels $39_a$–$39_b$–$39_c$ (FIG. 7) and for each bobbin four groups of idler wheels are provided, each of such groups comprising three wheels. Each group of three idler wheels has centers slightly offset with respect to one another and lying on a circumference coaxial with the reed circumference, as shown in FIG. 7, wherefore during the sliding of the shuttle on blades 41 of reed 35, there is always a wheel which is surely (positively) supported on said blades, thus ensuring a continuous and regular sliding of parts free from jerks.

In fact, as shown in FIG. 7, in position P of the group of wheels 39, at least one wheel $39_a$ surely rests on a blade; in position $P_1$ two wheels, namely $39_a$ and $39_c$ are stably supported, while in position $P_2$ at least one wheel $39_c$ is stably supported.

The motion of the shuttles is obtained (FIG. 4) with the shuttle-pushing means rotating on cylindrical surfaces coaxial with the reed surface. These per se known shuttle-pushers are equipped, according to the invention, with wheels 42 which are friction motor-driven against the base of reed 35 in consequence of the rotation of supporting plate 36; the rotation of wheels 42 is transmitted, through wheels 43–44 and the cooperating belt 45, to shuttle-pushing wheel 46; such arrangement permits the passage of the warp threads, emerging from the bottom and directed upwards, through the contact area between shuttle-pusher and shuttle (FIG. 4).

The value of the angle $\alpha$ referred to above depends upon the vertical dimension of the shuttle 31 and upon the radius of the wings which radius is the length of, for example, wing 16 in FIG. 4. In fact, with the same radius, the greater the angle $\alpha$ the greater the spreading apart of the warp threads, i.e., the greater the wave pitch which allows the passage of shuttle 31. It is of course not possible to give a general formula for the angle $\alpha$ but as an illustrative example, if the vertical dimension of shuttle 31 is 247 mm and the radius of wings is about 765 mm an angle $\alpha$ of about 7° is very satisfactory.

The circular loom illustrated above, fed according to any of the conventional methods, permits (also due to the particular shuttle-reed coupling) very high shuttles containing bobbins of great capacity and such as to ensure a high productivity of the loom and a very low degree of noise.

What is claimed is:

1. A circular loom for tubular fabrics made of threads and/or strips of polymeric, natural and similar materials, of the type with heddles arranged on two concentric circles and with a central driving shaft, characterized in that it comprises, for the alternate spreading apart of the internal and external warp threads, a supporting member, mounted coaxially and rotating around the central and vertical shaft of the loom, on which supporting member one or more pairs of wings or circular sectors diametically opposed to one another are coupled at a predetermined angle of inclination to the axis of said central shaft, each pair of wings being coupled in an inclined manner on said supporting element with interposition of a roller bearing so as to prevent said wings, through means oscillatorily connecting such wings with fixed parts of the loom, from rotating around said supporting element when the loom is working and thus allowing the wings to assume a continuous undulatory motion, the end portions of said opposite wings being connected, through a plurality of tie rods, with eye-bearing elastic elements acting as elastic heddles so as to transmit the undulatory motion of said wings to the elastic heddles and therefore to achieve, along the development of the loom reed and by utilizing more pairs of wings, the necessary spreading apart of the warp threads adapted to form the wave pitch; rolling means associated with the usual shuttle-pushing devices as well as multi-wheel devices, associated with the shuttles, capable of providing a support, and a guide for the shuttles on the blade reed being furthermore provided for the shuttle control or drive.

2. A circular loom according to claim 1, characterized in that said supporting member for said pairs of wings or circular sectors consists essentially of a tubular shaft which is adapted to rotate coaxially with the vertical shaft of the loom, and on which as many coaxial bushings as there are pairs of opposite wings are keyed, each of said bushings having its own outer cylindrical surface inclined at a predetermined angle in relation to the axis of rotation of the loom shaft and of the bushing-holding shaft, a roller bearing supporting, in its turn, a pair of opposite wings and being arranged on said inclined cylindrical surface.

3. A circular loom according to claim 1 or claim 2, characterized in that said means for the oscillatory connection of each wing with a fixed part or portion of the loom consists essentially of clamping or locking means, preferably pendulum-connecting means, suitable for allowing the wings, when the loom is in operation, to oscillate in a substantially vertical plane without angular shifting around the loom shaft, while said eye-bearing elastic elements acting as heddles are made of arcuate or bent steel wires and connected with a fixed part of the loom.

4. A circular loom according to any one of claims 1 to 3, characterized in that, in order to achieve the forming of the wave pitch of the warp threads capable of reversing at every passage of the shuttle, the tubular bushing-holding shaft is subjected to a speed of rotation which is twice that of the loom shaft when the loom is equipped with four shuttles, three times the loom shaft speed when the loom is equipped with six shuttles, and, generally, in accordance with the principle that the speed of the bushing-holding shaft is equal to that of the loom multiplied by half the number of shuttles.

5. A circular loom according to any one of claims 1 to 4, characterized in that each shuttle is equipped with at least one projecting sliding shoe, which is adapted to be guided within a groove or recess contained in the center of the blade-reed, and with groups of supporting idler wheels rolling on the inside surface of the cylindrical reed, each group of wheels consisting of three wheels having their center of rotation offset in respect of the said shafts, so as to provide a safe and jerk-free support for the shuttles of the reed.

6. A circular loom according to any one of claims 1 to 5, in which said usual shuttle-pushing devices are actuated by wheels which are freely mounted on a disc-shaped element driven by a loom shaft and are driven by friction against the base of the cylindrical reed.

* * * * *